United States Patent [19]

Banasiak et al.

[11] Patent Number: 4,702,479

[45] Date of Patent: Oct. 27, 1987

[54] DISPLAY APPARATUS FOR PLAYING CARD SUITS

[75] Inventors: Joseph Banasiak; Samuel L. Powers, both of Hendersonville, Tenn.

[73] Assignee: Miniature Electronics, Inc., Hendersonville, Tenn.

[21] Appl. No.: 836,254

[22] Filed: Mar. 5, 1986

[51] Int. Cl.[4] ..... A63F 1/18

[52] U.S. Cl. ..... 273/148 R; 40/451

[58] Field of Search ..... 273/148 R, 1 ES, 85 CP; 40/447, 448, 449, 450, 451, 452, 446; 340/323 R

[56] References Cited

U.S. PATENT DOCUMENTS

| | | | |
|---|---|---|---|
| 1,089,798 | 3/1914 | Smith . | |
| 1,091,335 | 3/1914 | Herrmann . | |
| 1,660,254 | 2/1928 | Carroll . | |
| 2,137,360 | 11/1938 | Skelsey | 40/130 |
| 3,420,526 | 1/1969 | Berger | 273/148 R |
| 3,758,973 | 9/1973 | Miller | 40/451 |
| 4,024,532 | 5/1977 | Sherwin . | |
| 4,030,764 | 6/1977 | Mattos | 273/148 R |
| 4,261,126 | 4/1981 | Bezjin | 40/447 |

*Primary Examiner*—Anton O. Oechsle

*Attorney, Agent, or Firm*—Leudeka & Neely

[57] ABSTRACT

An apparatus for displaying one of the four playing card suits (hearts, diamonds, clubs, spades) includes a plurality of segments for being selectively illuminated. The segments are configured in the shape of the four playing card suits with all four suits being overlaid one over the others, and the segments are arranged so that some of the segments form parts of different playing card suits. The segments are illuminated in sets so that the illuminated segments form any one of the four playing card suits. In a preferred embodiment, the segments are configured into a first group that forms a quadrangle and a second group of segments that form arches extending between the corners of the quadrangle and lying outside of the quadrangle.

7 Claims, 5 Drawing Figures

DISPLAY APPARATUS FOR PLAYING CARD SUITS

DISPLAY APPARATUS FOR PLAYING CARD SUITS

1. Field of Invention

The present invention relates to display boards and more particularly relates to a display board for displaying any one of the four playing card suits.

2. Background and Summary of the Invention

Numerous electronic machines have been devised to play or to facilitate the playing of card games, and during the process of playing the game, it is usually necessary for the machine to display one or more of the four playing card suits. For example, a card playing machine will usually display a number of cards representing its own hand and it will display a number of cards representing the individual's hand. To represent the hands, the machine must display both a number and a representation designating the suit of the particular card displayed. Also, to play some games such as bridge, it would be necessary for the machine to display a trump suit. For example, U.S. Pat. Nos. 4,030,764 and 3,420,526 disclose bidding devices for a bridge game, and in each of these devices, indicators are used to designate or display a particular suit.

Numerous displays have been devised for displaying more than one character in a single position. For example, U.S. Pat. Nos. 1,091,335; 1,660,254; 2,137,360; and 4,024,532 each disclose a module for displaying any one of a number of different characters which are typically either characters of the Latin alphabet or Arabic numerals. U.S. Pat. No. 1,089,798 dicloses an electric score board for baseball that displays information regarding the status and results of a particular hitter. However, these patents do not disclose a single display device for displaying any one of the four playing card suits in a single position or device.

The present invention is a single display board that may be used to display any one of the four playing card suits. Having a single display apparatus that will display all four suits will result in a savings of space and expense as compared to displays that provide four different displays, one for each suit. Also, the ability to display any one of four suits in the same position offers several functional advantages in many types of games. For example, in a bridge game, the trump suit could be displayed in the same position for every hand, regardless of the trump suit. If four displays are used to indicate the trump suit, the trump suit indicator must necessarily move through four different positions. Also, for example, a poker machine that is displaying the make up of a poker hand would be more easily read if the suits of each particular card were located in the same position each time. Thus, a display that has the capability of displaying any one of four suits in the same position offers a significant functional advantage as well as cost savings.

In accordance with the present invention, a display apparatus is provided for displaying one of the four playing card suits in a single position. The apparatus includes a plurality of segments for being selectively displayed, preferably by illumination, and the segments are configured into the shape of the four playing card suits with all four suits being overlaid one over the others. The segments are arranged so that some of the segments form a part of two or more different playing card suits. The segments are illuminated in sets and any one of four different sets of segments may be illuminated so that the illuminated sets may form any one of the four playing card suits.

In the preferred embodiment, the segments are formed into first and second groups. The first group of segments is configured into a quadrangle and it forms the diamond, part of the heart and part of the spade. The second group is configured into arches extending between the corners of the quadrangle and lying outside of the quadrangle. This second group of segments forms the club, part of the heart and part of the spade. An illumination source is operable to illuminate any one of four sets of the segments so that the illuminated segments represent any one of the four playing card suits.

Also, in the preferred embodiment, a separate segment is disposed proximate to one corner of the quadrangle to form a part of the spade. The source of illumination is operable to illuminate the separate segment, the segments forming two arches nearest the separate segment and the segments forming the two sides of the quadrangle that are most distal from the separate segment in order to form or represent the spade. In an alternate embodiment, the segments are arranged basically in the configuration of the above described preferred embodiment except that some of the segments are red, some of the segments are blue and some of the segments are double segments so that they can be either red or blue. In this manner, by appropriately selecting the segments for illumination, the spade and the club are blue when displayed, and the heart and diamond are red.

BRIEF DESCRIPTION OF THE DRAWINGS

The present invention may best be understood by reference to the following Detailed Description of preferred embodiments when considered in conjunction with the Drawings in which.

DETAILED DESCRIPTION

Figure 1:
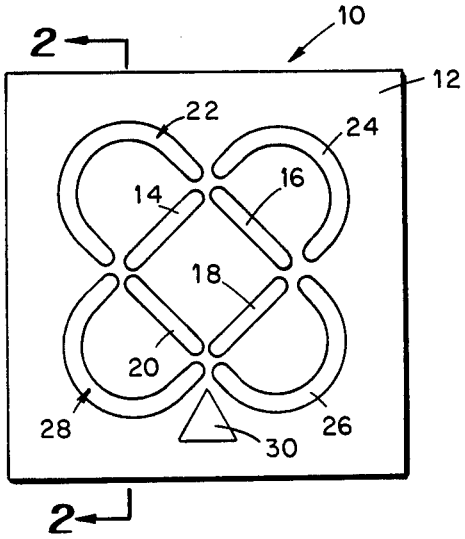
FIG. 1 is a front view of a preferred embodiment of the four suit display board.

Referring now to the Drawings in which like reference characters designate like or corresponding parts throughout the several views, there is shown in FIG. 1 a front view of a display apparatus 10 that includes a display board 12 formed with a plurality of segments 22–30 for being illuminated. FIG. 1 is somewhat diagrammatical in that the apparatus 10 would never appear as it is shown in FIG. 1 because FIG. 1 illustrates the apparatus 10 as if all of the segments 22–30 were illuminated. In actual use, only selected sets of the segments 22–30 would be illuminated at any one time.

The segments 14, 16, 18 and 20 are linear and are configured to form a quadrangle (any four-sided figure), in this case, a square. The segments 22, 24, 26 and 28 are configured in arches that extend between positions proximate to the corners of the quadrangle defined by the segments 14, 16, 18 and 20. A segment 30 is formed in the board 12 in the shape of a stem for a club and a spade base and it is disposed proximate to the lowermost corner of the quadrangle defined by segments 14, 16, 18 and 20. As shown in FIG. 1, it will be appreciated that the quadrangle of segments 14, 16, 18 and 20 is oriented in a diamond pattern with one corner pointed directly downwardly, and the separate segment 30 is disposed below the lowermost segment of the quadrangle. Referring to FIG. 1, it may be appreciated that this single display may be used to display any one of the four of playing card suits. A heart is displayed by illuminating segments 22, 24, 20 and 18; a diamond by illuminating segments 14, 16, 18 and 20; a club by illuminating segments 22, 24, 26, 28 and 30; and a spade by illuminating segments 14, 16, 26, 28 and 30. It will be appreciated that there is a considerable efficiency of design with respect to the number of segments required to display all four playing suits since the arched segments 22, 24, 26 and 28 form all or part of every suit except diamonds, and the linear segments 14, 16, 18 and 20 form all or part of every suit except clubs.

Figure 2:
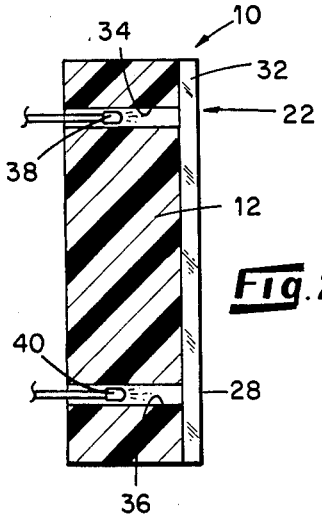
FIG. 2 is a somewhat diagrammatical cross-sectional view of the display board of FIG. 1 taken through line 2—2.

Referring now to FIG. 2, there is shown a cross-sectional view of the apparatus 10 taken through cross-section line 2—2 shown in FIG. 1. In this cross-sectional view, the board 12 has been cut across segments 22 and 28 which are visible through a diffusion lens 32. The segments 22 and 28 are actually formed by slots 34 and 36 that are cut in the board 12 and a plurality of light sources, such as lamps 38 and 40, are disposed within the slots 34 and 36 to create the segments 22 and 28 for illumination. It will be understood that the construction of segments 22 and 28 is typical and that the remaining segments 14, 16, 18, 20, 24, 26 and 30 are constructed in a substantially identical fashion.

The lamps 38 and 40 are representative of a plurality of light sources that may be located within each of the segments 22–30. For example, slot 34 could contain a plurality of light emitting diodes, neon glow tubes or other light sources. Alternatively, the segments could be illuminated by appropriately shielded light sources behind the board 12. In using the phrase "segments for being illuminated", "light segments" or similar phrases, it will be understood that these phrases refer to either a structure that is lighted or a light source. Although the segments 14–30 in FIGS. 1 and 2 are slots (such as 34 and 36), diffusion lens 32 and lamps (such as 38 and 40), the segments could also be light sources such as glow tubes or liquid crystal diodes configured in the shape of the segments.

Figure 3:
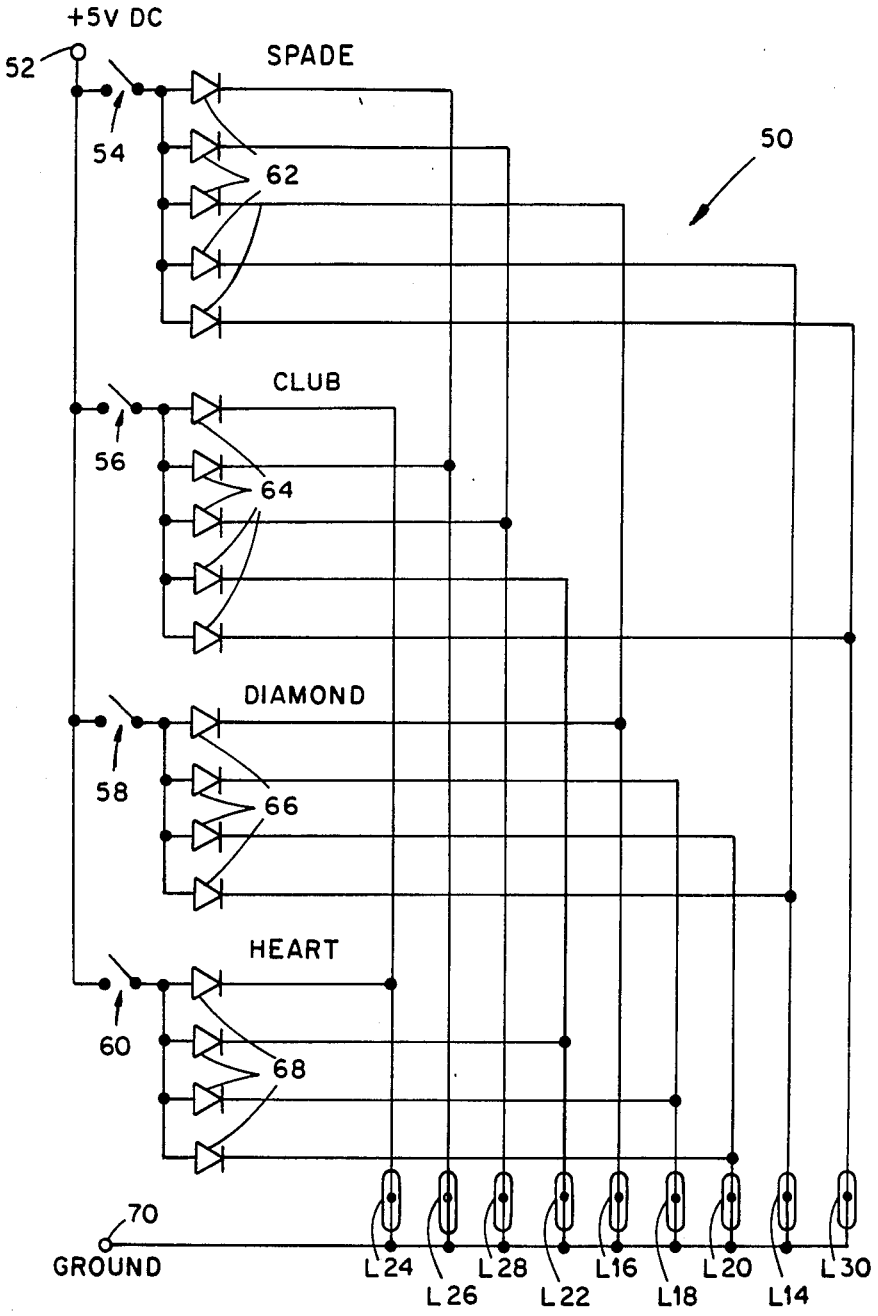
FIG. 3 is a diagram of one circuit that operates to display any one of the four playing card suits in the display board of FIG. 1.

Referring now to FIG. 3, there is shown a diagram of a circuit 50 for controlling the illumination of the dislay apparatus 10. The circuit 50 includes a five volt DC source 52 that is connected through four switches 54, 56, 58 and 60 and four banks of AND gates 62, 64, 66 and 68 to control the illumination of lights L14–L30 which are also connected to ground 70.

To illuminate a spade on the display board 12 (FIG. 1), the switch 54 is closed. This provides a five volt input to all of the inputs of the AND gates 62. The AND gates are likewise powered by the five volt DC source, and when switch 54 is closed, five volts will appear at the output of the AND gates 62 and lights L26, L28, L16, L14 and L30 will be illuminated to generate the representation of a spade as shown in FIG. 1. It will be understood that the reference characters identifying the lights L14–L30 correspond to the characters 14–30 that identify the segments in FIG. 1. That is, L14 illuminates segment 14, L16 illuminates segment 16, etc.

To display a club, switch 56 is closed which will place a five volt output on the AND gates 64 and lights L24, L26, L28, L22 and L30 will be illuminated. In like manner, to display a diamond, switch 58 is closed to illuminate lights L16, L18, L20 and L14; and to display a heart, switch 60 is closed to illuminate lights L24, L22, L18 and L20.

Although the switches 54, 56, 58 and 60 are shown as manual mechanical switches, it will be understood the circuit 50 is representative of many different types of circuits that could be used to control the illumination of the segments 14–30 shown in FIG. 1. In most applications, it is probable that manual mechanical switches would not be used and that relays or solid state switches controlled by a microprocessor or other type of controller would be used to switch the lights L14–30 "on" and "off".

It will also be understood that lights L14–L30 each represent one or a plurality of lights that are used to illuminate the corresponding segments 14–30. For example, Sylvania lamps 6805AS15 or 6803AS25 would be appropriate for use in this application. Of course, other types of illumination sources may be used as well.

Figure 4:
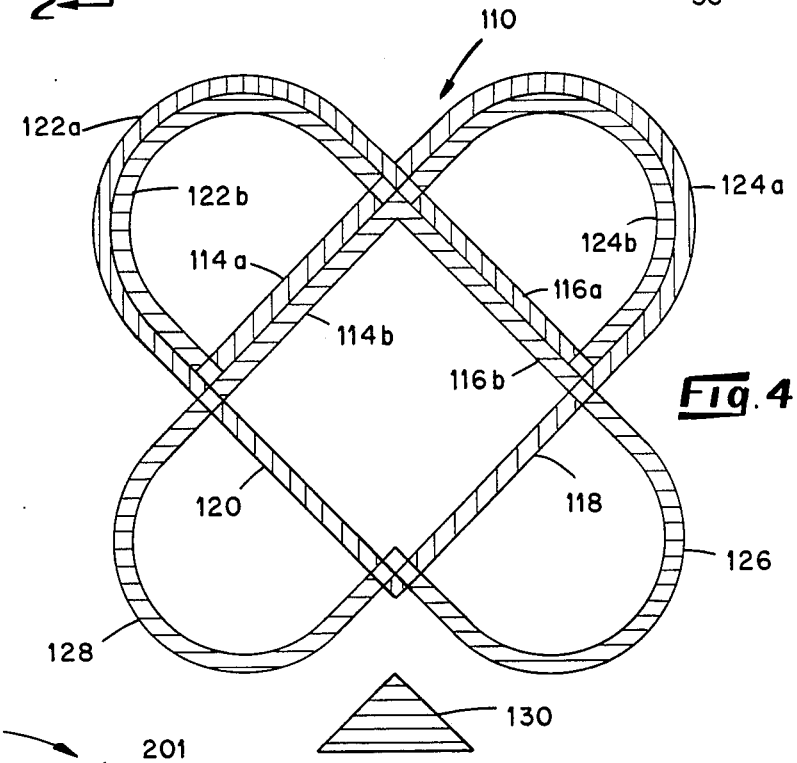
FIG. 4 is an illustration of an alternate embodiment of the display board in which hearts and diamonds are red and clubs and spades are blue.

An alternate embodiment of the invention, display apparatus 110, is shown in FIG. 4. In this embodiment, four of the segments are doubled so that the hearts and diamonds are displayed in red and the spades and clubs are displayed in blue. The segments of apparatus 110 have references characters that correspond to the segments shown in FIG. 1 by simply adding 100 to each reference character of FIG. 1. The segments 118, 120, 126, 128 and 130 are essentially the same as the corresponding segments shown in FIG. 1 except that segments 118 and 120 are red and segments 126, 128 and 130 are blue when illuminated. The remaining segments shown in FIG. 4 are doubled. Where one segment 14 is shown in FIG. 1, two segments **114*a* and 114*b* are provided in FIG. 4. In like manner, double segments 116*a* and 116*b*; 124*a* and 124*b*; and 124*a* and 124*b* are provided to complete the display apparatus 110. In each of the double segments shown in FIG. 4**, the segment having a reference character followed by the letter "a" is red when illuminated and a segment designated by the reference character followed by the letter "b" is blue when illuminated.

It will be noted that the red and blue segments of the apparatus 110 are aligned to properly form representations of the playing card suits. Segment **112*a* is aligned with segment 120 and 116*a*. In like manner, segment 124*a* is aligned with segment 118 and 114*a*; segment 124*b* is aligned with segment 114*b*; and segment 112*b* is aligned with segment 116*b*. Also, segments 120 and 118 are symmetrically positioned to form a square with segments 114 and 116*b*. To form a representation of a playing card suit, the segments are illuminated as follows: a heart is formed by illuminating segments 122*a*, 124*a*, 120 and 118; a diamond by illuminating segment 114*a*, 116*a*, 120 and 118; a spade by illuminating segments 114*b*, 116*b*, 128, 126 and 130; and a club by illuminating segments 122*b*, 124*b*, 128, 126 and 130**.

The circuit as shown in FIG. 3 is appropriate for controlling the illumination of the display apparatus 110 as shown in FIG. 4 except that additional lights must be added for the doubled segments. For example, when desired to illuminate a spade, switch 54 will be closed, and in place of L28 a separate lamp would be substituted therefor. In like manner, separate lamps would be substituted for L26, L14, for L16, and L30. The circuit would be likewise modified for each of the other switches 56, 58 and 60 to produce the remaining suits as shown in FIG. 4.

Figure 5:
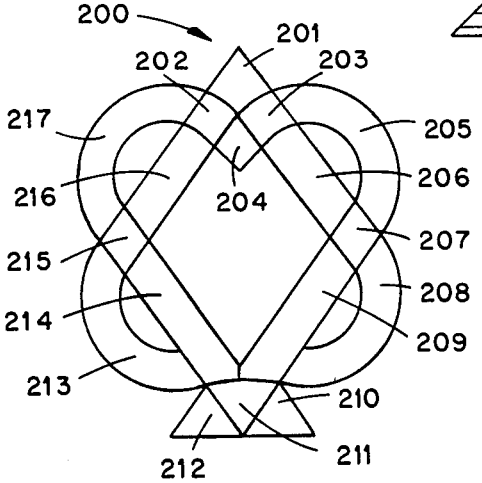
FIG. 5 is an alternate embodiment of the display board that uses more segments to achieve greater detail in displaying the suits.

FIG. 5 discloses yet another embodiment, display apparatus 200, of the invention in which the suits are divided into more segments so that a more detailed representation of each suit may be obtained. In this embodiment, the overlaid suits are divided into seventeen segments labeled 201–217. It will be appreciated that the segments are arranged in a pattern substantially similar to that shown in FIGS. 4 and 1, but that additional segments have been provided to more finely detail the suits. The quadrangle is roughly formed in FIG. 5 by segments 206, 209, 214 and 216, and the four arches are roughly formed by segments 205, 208, 213 and 217. Thus, it will be appreciated that the apparatus 200 of FIG. 5 has the same general shape as that of apparatus 110 and apparatus 10.

In operation, the dislay apparatus 200 forms a display of the various suits by illuminating selected ones of segments 201–217 in the same manner as described above with references to FIGS. 1 and 4. The segments which form the various suits are as follows: a heart segments 204, 203, 205, 207, 209, 211, 214, 215, 217, 202; a diamond, segments 201, 203, 206, 207, 209, 211, 214, 215, 216 and 202; a club, segments 204, 203, 205, 207, 208, 210, 211, 212, 213, 215, 217 and 202; and a spade, segments 201, 203, 206, 207, 208, 210, 211, 212, 213, 215, 216 and 202.

The segments of FIG. 5 would be illuminated in the same manner as described with respect to FIGS. 1 and 2 and a circuit for controlling FIG. 5 would be constructed in accordance with the circuits shown in FIG. 3.

Although particular embodiments have been described in the foregoing Detailed Description, it will be understood that the invention is capable of numerous rearrangements, modifications and substitutions of parts without departing from the scope of the invention as defined in the appended claims. In particular, it should be noted that the display segments shown in FIGS. 1, 4 and 5 represent segments that are selectively visible, such as a photodiode array, liquid crystal diodes or other display devices. The above Detailed Description is intended to illustrate preferred embodiments and is not intended to limit the scope of the invention.

What is claimed is:

1. A display apparatus for displaying any one of the four playing card suits of hearts, diamonds, spades and clubs, comprising:

a plurality of segments for being selectively displayed;

a first group of said segments being configured into a quadrangle to form the diamond, part of the heart and part of the spade;

a second group of said segments being configured into arches extending between positions proximate to the corners of the quadrangle and lying outside of the quadrangle, said second group of said segments forming the club, part of the heart and part of the spade; and means for displaying any one of four sets of said segments so that the set of displayed segments form representations of any one of the four playing card suits.

2. The apparatus of claim 1 further comprising:

a separate segment for being selectively displayed disposed proximate to one corner of the quadrangle to form part of the spade and club; and said means for displaying being operable to illuminate the separate segment when the club or spade is displayed on the apparatus.

3. The apparatus of claim 1 wherein: said first group of segments comprise segments of a first color formed into a quadrangle and segments of a second color disposed along two adjacent sides of the quadrangle;

said second group of segments comprise segments of the second color forming four arches extending between the four corners of said quadrangle and segments of the first color forming two arches disposed along two adjacent arches of the second color; and said means for displaying being operable to display the segments of the second group of the second color to represent a club, to display the segments of the first group of the first color to represent a diamond, to display the segments of the first group of the second color and two arches of the second group of the second color to represent a spade, and to display segments of the first group of the first color forming two adjacent sides of the quadrangle and the segments of the second group of the first color to represent a heart.

4. The apparatus of claim 3 further comprising:

a separate segment disposed proximate to one corner of the quadrangle to form part of the spade; and said means for displaying being operable to display said separate segment when the spade or club is displayed.

5. The apparatus of claim 1 wherein said segments comprise electric glow tubes.

6. The apparatus of claim 1 wherein said segments comprise liquid crystal diodes.

7. The apparatus of claim 1 wherein said segments comprise a display board having a plurality of slots formed therein; and a light source for illuminating selected groups of said slots.

* * * * *